US007159290B1

(12) United States Patent
Liu

(10) Patent No.: US 7,159,290 B1
(45) Date of Patent: Jan. 9, 2007

(54) MANUAL HYDRAULIC RIVETER

(76) Inventor: Pao Fang Liu, No. 7, Lane 4, Kuang Sheng Hsin Cheng, San I Hsiang, Miao Li Hsien (TW)

( * ) Notice: Subject to any disclaimer, the term of this patent is extended or adjusted under 35 U.S.C. 154(b) by 0 days.

(21) Appl. No.: 11/533,415

(22) Filed: Sep. 20, 2006

(51) Int. Cl.
*B21J 15/20* (2006.01)

(52) U.S. Cl. ..... 29/243.523; 29/243.524; 72/453.17

(58) Field of Classification Search ..... 29/243.521, 29/243.523, 243.524, 243.525; 72/391.6, 72/391.4, 453.17
See application file for complete search history.

(56) References Cited

U.S. PATENT DOCUMENTS 3,688,551 A * 9/1972 Alm ..... 29/243.524
3,713,321 A * 1/1973 LaPointe ..... 29/243.524
4,086,802 A * 5/1978 Ewig, Jr. ..... 29/243.524
4,248,077 A * 2/1981 Gregory ..... 29/243.524
4,263,801 A * 4/1981 Gregory ..... 29/243.524
4,462,240 A * 7/1984 Yamamoto ..... 72/391.8
4,750,347 A * 6/1988 Saarinen ..... 29/243.524
5,425,164 A * 6/1995 El Dessouky ..... 29/243.524
5,682,659 A * 11/1997 Chang ..... 29/243.523

* cited by examiner

*Primary Examiner*—David B. Jones
(74) *Attorney, Agent, or Firm*—Sinorica, LLC; Ming Chow

(57) ABSTRACT

A manual hydraulic riveter includes a body, a lever pivoted to the body for moving a first piston in a fluid cylinder to force hydraulic fluid through a first fluid pipe to a hydraulic cylinder to further move a second piston and an actuating rod carrying a riveting unit. When released the lever, the second piston is returned by a spring to force hydraulic fluid out of the hydraulic cylinder through a third fluid pipe and a second fluid pipe to the fluid cylinder.

12 Claims, 6 Drawing Sheets

MANUAL HYDRAULIC RIVETER

BACKGROUND OF THE INVENTION

1. Field of the Invention

The present invention relates to riveters and more particularly, to a manual hydraulic riveter, which utilizes the characteristics of check valve and relief valve to facilitate the operation.

2. Description of the Related Art

A riveter is a tool for use to fasten plate members with rivets. When the shank of a rivet is inserted through holes on plate members into the riveting mechanism of the riveter with the factory formed head of the rivet stopped at one side of one plate member, the lever of the riveter is operated to pull the shank of the rivet, thereby deforming the plain end of the rivet to form another head at the opposite side of the opposite plate member, and therefore the plate members are fastened together.

Conventional riveters allow adjustment of the riveting mechanism to the desired angle. However, when the lever of a conventional riveter is biased to extend out of the riveting mechanism for securing the shank of a blind rivet, the lever and the transmission rod are aligned in line. Subject to the principle of lever, the user must employ much effort to turn the lever downwardly backwards to further achieve the riveting action.

Therefore, it is desirable to provide a riveter that eliminates the aforesaid drawback.

SUMMARY OF THE INVENTION

The present invention has been accomplished under the circumstances in view. It is one object of the present invention to provide a manual hydraulic riveter, which uses the characteristics of check valve and relief valve to facilitate the operation, enabling the user to drive the riveting unit with less effort.

To achieve this and other objects of the present invention, the manual hydraulic riveter comprises a body, which holds a fluid cylinder, a fluid tank and a hydraulic cylinder, a first piston mounted in the fluid cylinder and movable between two opposite ends of the fluid cylinder, a lever pivoted to the body and adapted to move the first piston in the fluid cylinder between the two opposite ends of the fluid cylinder, a first fluid pipe connected between the fluid cylinder and the hydraulic cylinder, a first check valve mounted in the first fluid pipe, a second fluid pipe connected between the fluid tank and the hydraulic cylinder, a second check valve mounted in the second fluid pipe, a third fluid pipe connected between the hydraulic cylinder and the fluid tank, a relief valve mounted in the third fluid pipe, an actuating rod axially movably and rotatably mounted in the body and partially extending out of the body for mounting a riveting unit, a second piston fixedly mounted on the actuating rod in the hydraulic cylinder and movable between two opposite ends of the hydraulic cylinder, and spring means mounted on the actuating rod inside the hydraulic cylinder and stopped between one end of the hydraulic cylinder and the second piston to impart a forward pressure to the second piston. The first check valve is opened, and the second check valve and the relief valve are closed when biasing the lever to move the first piston in the fluid cylinder. On the contrary, the first check valve is closed, and the second check valve and the relief valve are opened when the external biasing force is released from the lever.

DETAILED DESCRIPTION OF THE PREFERRED EMBODIMENT

Figure 1:
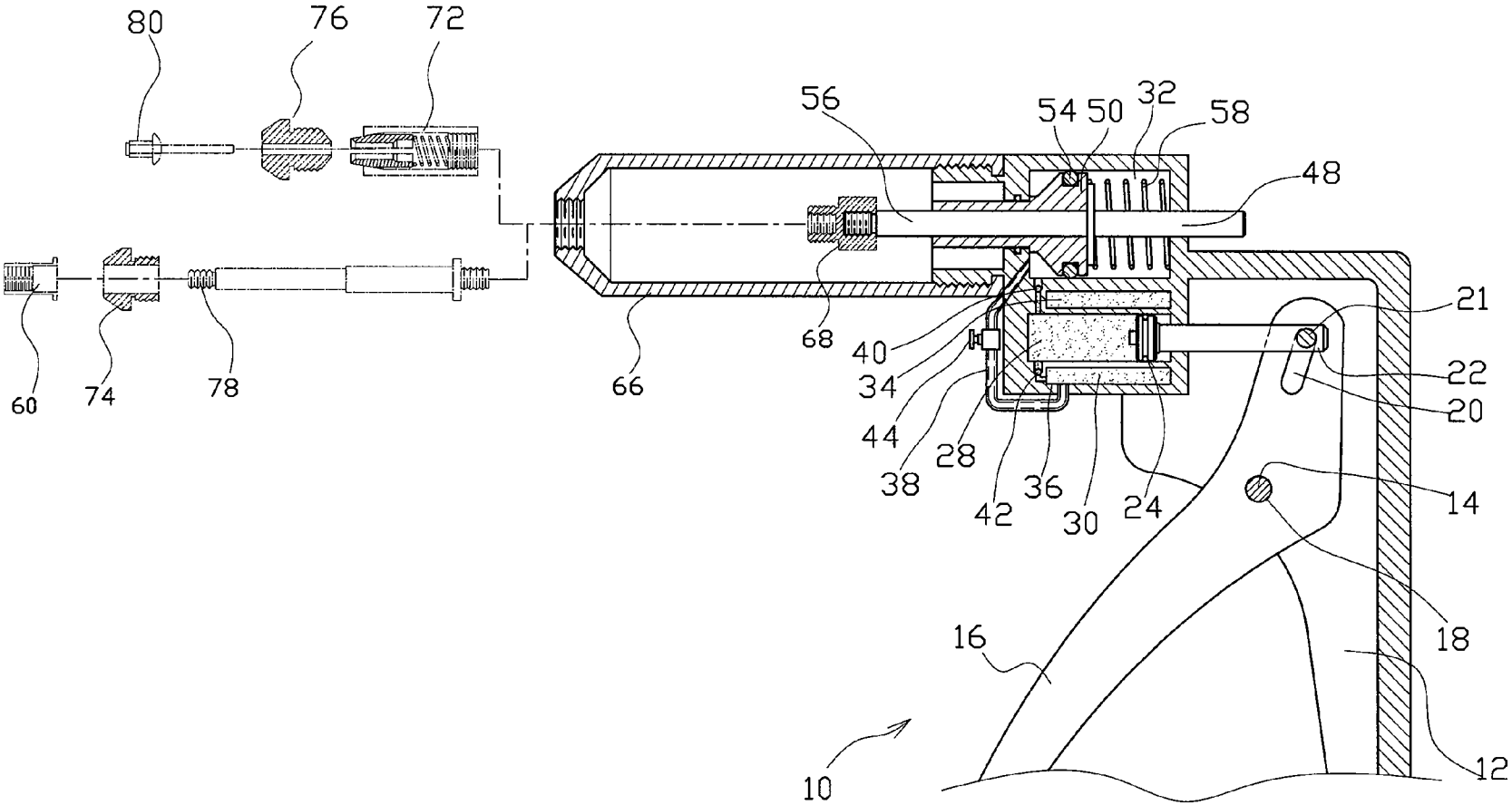
FIG. 1 is a schematic exploded view of a manual hydraulic riveter according to the present invention.
Figure 2:
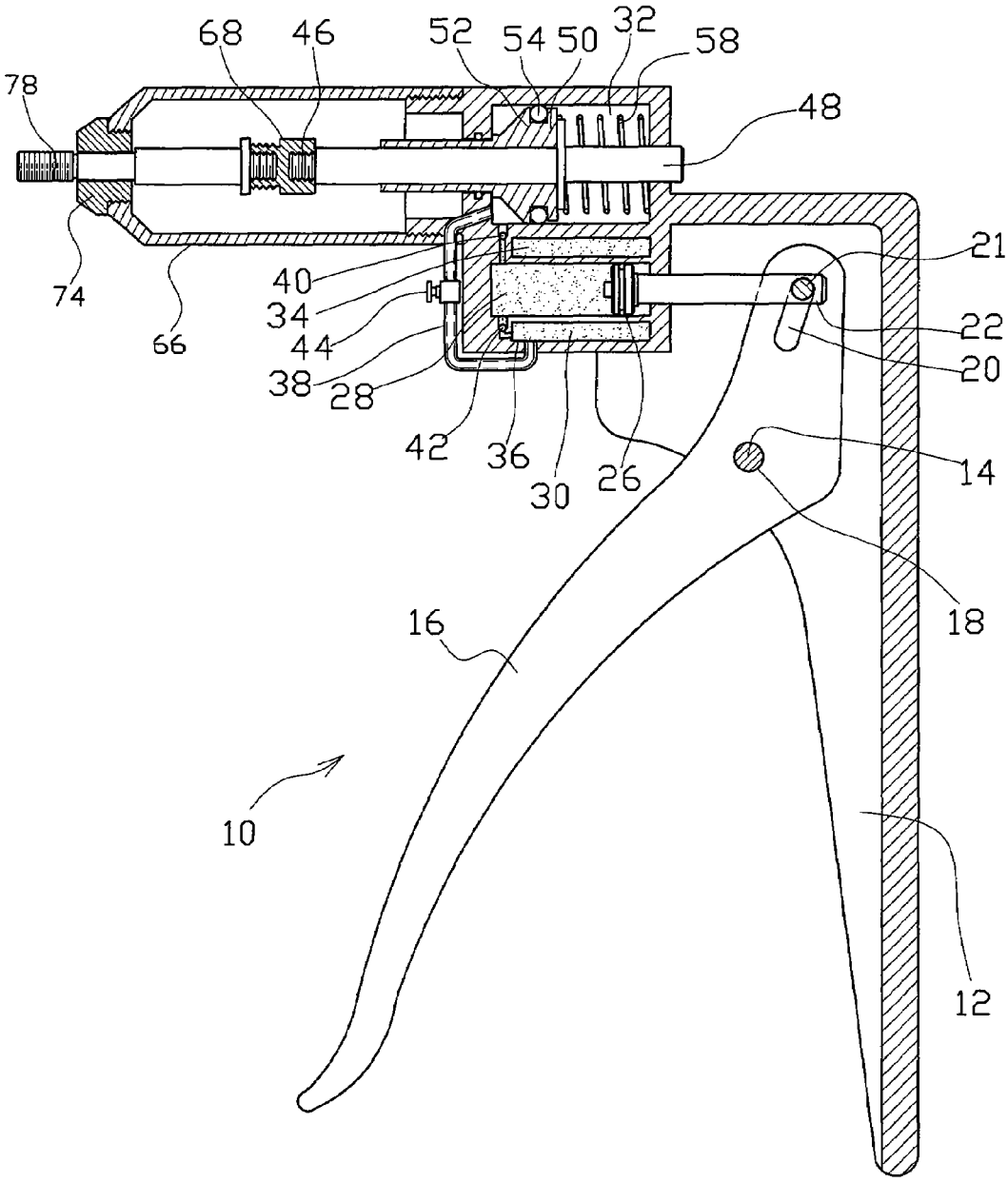
FIG. 2 is a schematic view of a manual hydraulic nut riveter according to the present invention.

FIG. 1 is a schematic exploded view of a manual hydraulic riveter according to the present invention. FIG. 2 is a schematic view of a riveting nut tool according to the present invention. As illustrated, the invention is practical for use as a riveter or riveting nut tool.

Referring to FIG. 2, the manual hydraulic riveter 10 comprises a body 12, which has a pivot 14, and a lever 16, which has a pivot hole 18 disposed near its one end and pivotally coupled to the pivot 14 for enabling the lever 16 to be biased relative to the body 12. The lever 16 has an elongated sliding slot 20 at its one end. A link 22 is coupled with its one end to the sliding slot 20 of the lever 16 by means of an o-ring or ball 24 so that when the lever 16 is biased relative to the body 10, the link 22 is moved axially. The link 22 is axially slidably mounted inside the body 12, having the other end connected to a piston 26 in a fluid cylinder 28 inside the body 12. According to this embodiment, the piston 26 is a T-shaped piston. The body 12 further holds a fluid tank 30 and a hydraulic cylinder 32. As illustrated in FIG. 2, the fluid tank 30 is a barrel. The fluid cylinder 28 is a cylindrical member mounted in the fluid tank 30.

The internal fluid loop is described hereinafter. A first fluid pipe 34 is connected between the fluid cylinder 28 and the hydraulic cylinder 32. A second fluid pipe 36 is connected between the fluid tank 30 and the fluid cylinder 28. A third fluid pipe 38 is connected between the hydraulic cylinder 32 and the fluid tank 30. These three fluid pipes 34~38 constitute with the fluid tank 30, the fluid cylinder 28 and the hydraulic cylinder 32 a fluid loop. Further, a first check valve 40 is installed in the first fluid pipe 24, a second check valve 42 is installed in the second fluid pipe 36, and relief valve 44 is installed in the third fluid pipe 38.

The internal structure of the hydraulic cylinder 32 and the front riveting unit of the manual hydraulic riveter 10 are now described hereinafter. The riveting unit can be a nut riveting or rivet riveting unit. For constructing a nut riveting unit, the front extension screw rod 46 of the actuating rod, referenced by 48 is mounted with a nut riveting device. For constructing a rivet riveting unit, the front extension screw rod 46 of the actuating rod 48 is mounted with a rivet riveting device. The actuating rod 48 is inserted through the hydraulic cylinder 32 inside the body 12. A piston 50 is fixedly mounted on the actuating rod 48 and axially movable with the actuating rod 48 within the hydraulic cylinder 32. The piston 50 has an annular groove 52 extending around the periphery. An O-ring 54 is fastened to the annular groove 52 of the piston 50 and disposed in contact with the inside wall of the hydraulic cylinder 32. The front extension screw rod 46 of the actuating rod 48 extends out of the body 12. An O-ring 47 is fastened to the actuating rod 48 to seal the gap between the actuating rod 48 and the body 12, preventing a leakage. As shown in FIG. 2, the actuating rod 48 has one end mounted inside the body 12, and the other end terminating in the aforesaid front extension screw rod 46 outside the body 12 for the mounting of a nut riveting or rivet riveting device. Further, during a nut riveting operation, the actuating rod 48 is rotated, driving the nut riveting device to achieve the desired nut riveting action. Further, a linear spring 58 is mounted on the actuating rod 48 inside the hydraulic cylinder 32, and stopped between the bottom wall of the hydraulic cylinder 32 and the piston 50.

Further, a connector 68 is threaded onto the front extension screw rod 56 of the actuating rod 48. The connector 68 has a first coupling portion and a second coupling portion. A pull rod 70 and a nut riveting bit 74 are respectively threaded onto the first coupling portion and second coupling portion of the connector 68. The connector 68, the pull rod 70 and the nut riveting bit 74 constitute a nut riveting unit. Alternatively, a rivet clamp 72 may be fastened to the connector 68 to hold a rivet riveting bit 76 with rivet 80, thereby constituting a rivet riveting unit. Therefore, rotating the actuating rod 48 causes rotation of the nut riveting unit or rivet riveting unit with the front extension screw rod 46.

Figure 3:
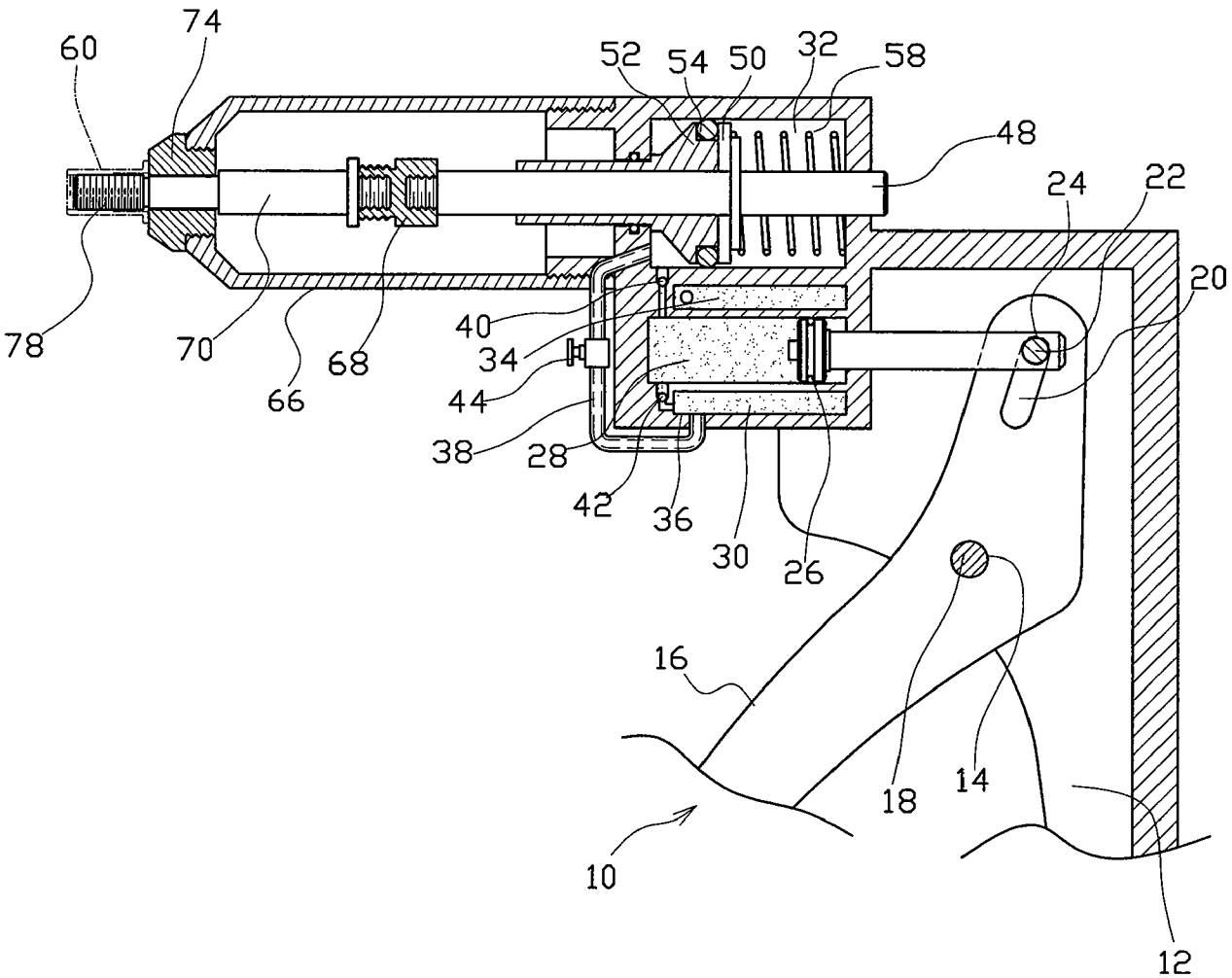
FIG. 3 is an enlarged view of a part of the manual hydraulic nut riveter shown in FIG. 2.

When a nut riveting unit is fastened to the front extension screw rod 46, a blind nut 60 is threaded onto the front extension screw rod 78 of the pull rod 70, and a pad 62 is sandwiched between the blind nut 60 and the nut riveting bit 74, as shown in FIG. 3.

Figure 4:
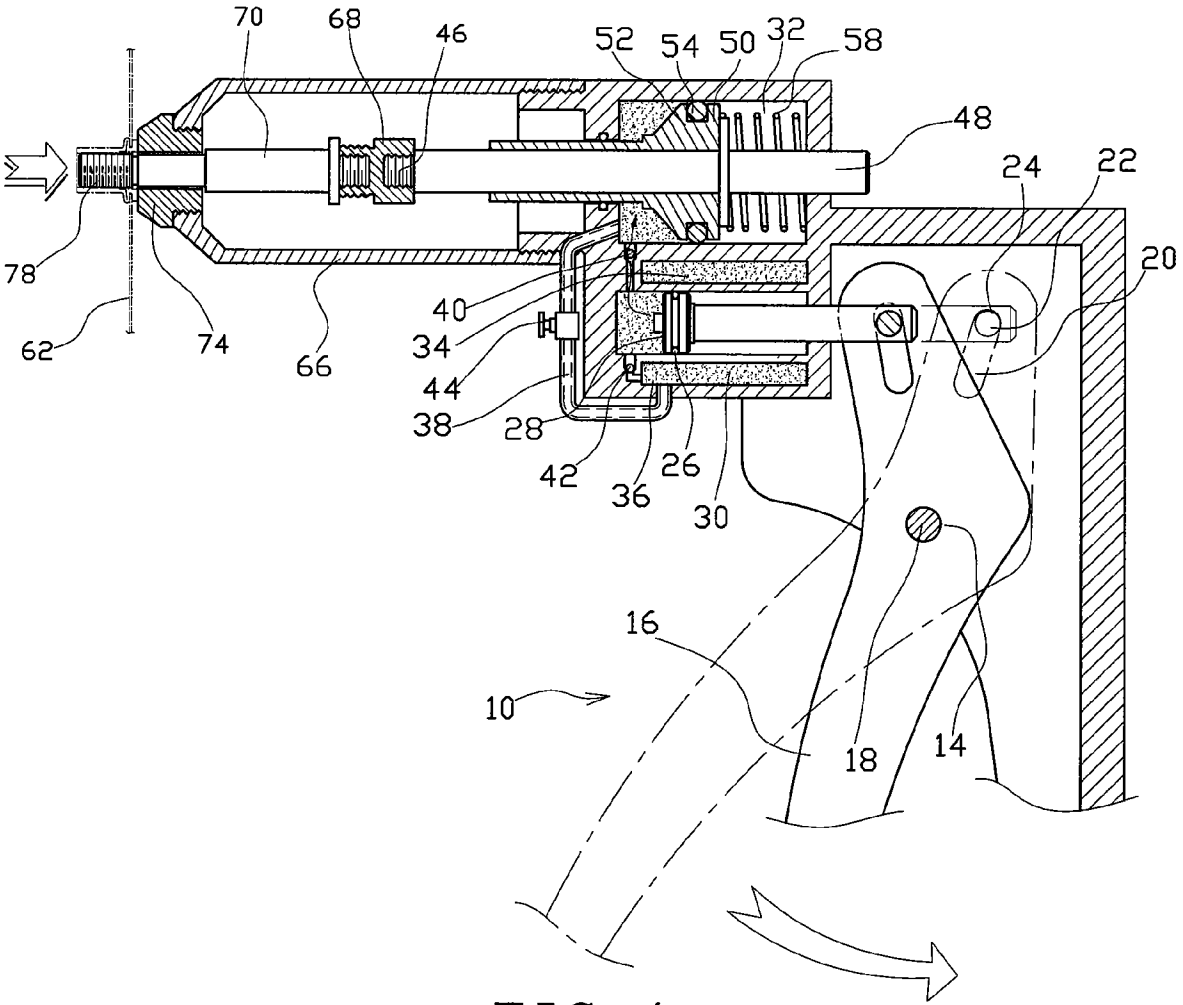
FIG. 4 is a schematic drawing showing the operation of the manual hydraulic riveter according to the present invention (I).

When the user holds the body 12 firmly with one hand and pulls the lever 16 with the other hand as shown in FIG. 4, the link 22 is driven to move the piston 26 relative to the fluid cylinder 28 and to squeeze hydraulic fluid out of the fluid cylinder 28 through the first fluid pipe 34 into the hydraulic cylinder 32. At this time, the first check valve 40 is opened, for allowing hydraulic fluid to pass through the first fluid pipe 34 into the hydraulic cylinder 32. Further, the second check valve 42 and the relief valve 44 are closed at this time. Therefore, hydraulic fluid is prohibited from passing out of the hydraulic cylinder 32 into the fluid tank 30. Therefore, hydraulic fluid is accumulated in the hydraulic cylinder 32 to impart a pressure to the piston 50 against the linear spring 58, thereby forcing the piston 50 to move the actuating rod 48 backwards toward the inside of the body 12, and therefore the connector 68 and the pull rod 70 are moved with the actuating rod 48 to force the blind nut 60 against the nut riveting bit 74, which deforms the blind nut 60 into a riveted nut 64.

Figure 5:
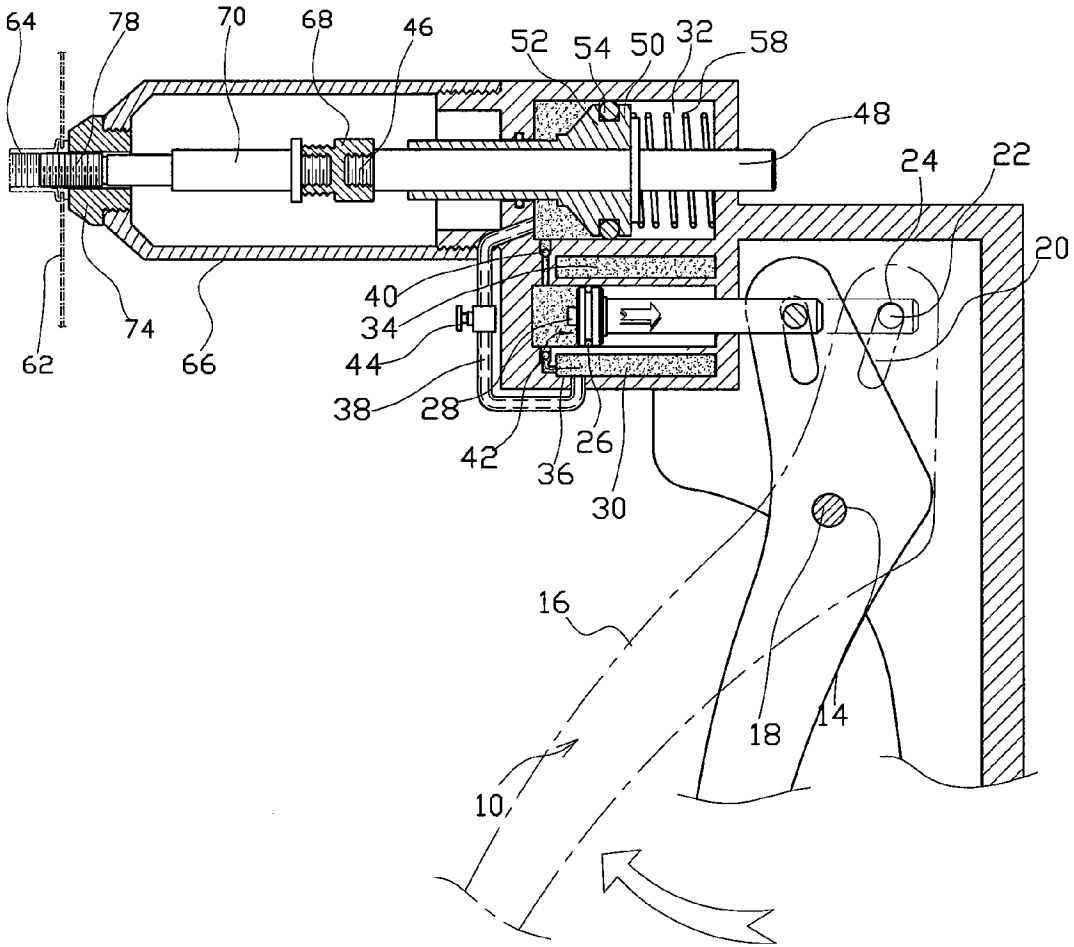
FIG. 5 is a schematic drawing showing the operation of the manual hydraulic riveter according to the present invention (II).

When released the lever 16 after riveting, as shown in FIG. 5, the linear spring 58 pushes the piston 50 to squeeze hydraulic fluid in the hydraulic cylinder. At this time, the first check valve 40 is closed, the second check valve and the relief valve 44 are opened, therefore hydraulic fluid is prohibited from flowing out of the hydraulic cylinder 32 into the fluid cylinder 28, and hydraulic fluid flows from the hydraulic cylinder 32 to the fluid tank 30 and then the fluid cylinder 28. At the same time, the piston 50 moves the actuating rod 48 to its former position (the initial position). Thus, the user can remove the riveted nut 64 from the manual hydraulic riveter.

Figure 6:
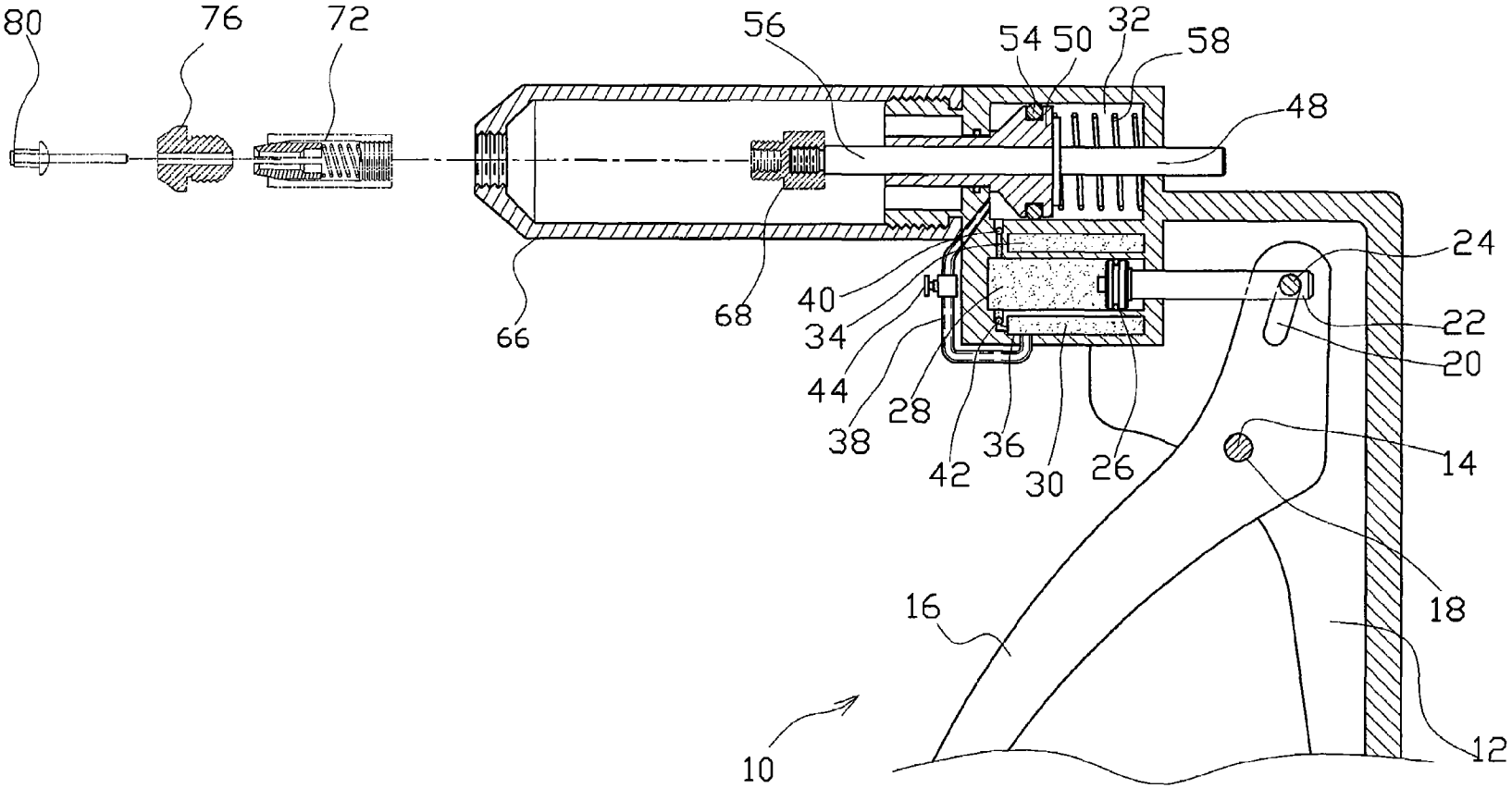
FIG. 6 is a schematic exploded view of an alternate form of the manual hydraulic riveter according to the present invention.

Referring to FIG. 6, a shell 66 may be fastened to the body of the manual hydraulic riveter by means of a screw joint, and a connector 68 is threaded onto the front extension screw rod 46 of the actuating rod 48, and then a rivet clamp 72 is fastened to the second coupling portion of the connector 68, and then a nail riveting bit 76 with rivet 80 is fastened to the rivet clamp 72.

A prototype of manual hydraulic riveter has been constructed with the features of FIGS. 1~6. The manual hydraulic riveter functions smoothly to provide all of the features discussed earlier.

Although particular embodiments of the inventions have been described in detail for purposes of illustration, various modifications and enhancements may be made without departing from the spirit and scope of the invention. Accordingly, the invention is not to be limited except as by the appended claims.

The invention claimed is:

1. A manual hydraulic riveter comprising:

a body, said body holding a fluid cylinder, a fluid tank and a hydraulic cylinder;

a first piston mounted in said fluid cylinder and movable between two opposite ends of said fluid cylinder;

a lever pivoted to said body and adapted to move said first piston in said fluid cylinder between the two opposite ends of said fluid cylinder, said lever having one end coupled to said first piston in said fluid cylinder;

a first fluid pipe connected between said fluid cylinder and said hydraulic cylinder;

a first check valve mounted in said first fluid pipe;

a second fluid pipe connected between said fluid tank and said hydraulic cylinder;

a second check valve mounted in said second fluid pipe;

a third fluid pipe connected between said hydraulic cylinder and said fluid tank;

a relief valve mounted in said third fluid pipe;

an actuating rod mounted in said body and axially movable and rotatable relative to said body, said actuating rod having a front end extending out of said body and holding a riveting unit;

a second piston fixedly mounted on said actuating rod in said hydraulic cylinder and movable between two opposite ends of said hydraulic cylinder; and spring means mounted on said actuating rod inside said hydraulic cylinder and stopped between one end of said hydraulic cylinder and said second piston to impart a forward pressure to said second piston.

2. The manual hydraulic riveter as claimed in claim 1, wherein said second piston has an annular groove extending around a peripheral wall thereof and an O-ring fastened to said annular groove and disposed in contact with an inside wall of said hydraulic cylinder.

3. The manual hydraulic riveter as claimed in claim 1, wherein said body has a pivot; said lever is coupled to and turnable about the pivot of said body.

4. The manual hydraulic riveter as claimed in claim 1, wherein said lever has an elongated sliding slot coupled to coupling means at one end of a link, which is axially movably inserted through said fluid cylinder and fixedly connected to said first piston.

5. The manual hydraulic riveter as claimed in claim 1, wherein said first check valve is opened and said second check valve and said relief valve are closed when said lever is biased by an external biasing force to move said first piston in said fluid cylinder.

6. The manual hydraulic riveter as claimed in claim 5, wherein said first check valve is closed and said second check valve and said relief valve are opened when said lever is released from said external biasing force.

7. The manual hydraulic riveter as claimed in claim 1, wherein said fluid tank is a barrel; said fluid cylinder is a cylindrical container mounted inside said fluid tank.

8. The manual hydraulic riveter as claimed in claim 1, wherein said first piston is a T-shaped piston.

9. The manual hydraulic riveter as claimed in claim 1, wherein said spring means is a linear spring.

10. The manual hydraulic riveter as claimed in claim 1, further comprising a link connected between one end of said lever and said first piston.

11. The manual hydraulic riveter as claimed in claim 1, wherein the riveting unit mounted on the front end of said actuating rod outside said body is a rivet riveting unit.

12. The manual hydraulic riveter as claimed in claim 1, wherein the riveting unit mounted on the front end of said actuating rod outside said body is a nut riveting unit.

* * * * *